US006186323B1

(12) United States Patent
Jansson et al.

(10) Patent No.: US 6,186,323 B1
(45) Date of Patent: Feb. 13, 2001

(54) TOOL PACKAGE

(75) Inventors: Conny Jansson; Bennet Ernlund, both of Enköping (SE)

(73) Assignee: Sandvik AB, Sandviken (SE)

( * ) Notice: Under 35 U.S.C. 154(b), the term of this patent shall be extended for 0 days.

(21) Appl. No.: 09/117,920

(22) PCT Filed: Feb. 14, 1997

(86) PCT No.: PCT/SE97/00254

§ 371 Date: Aug. 6, 1998

§ 102(e) Date: Aug. 6, 1998

(87) PCT Pub. No.: WO97/29974

PCT Pub. Date: Aug. 21, 1997

(30) Foreign Application Priority Data

Feb. 16, 1996 (SE) ..... 9600563

(51) Int. Cl.[7] ..... A45C 11/26

(52) U.S. Cl. ..... 206/349; 206/806; 206/376; 206/493

(58) Field of Search ..... 206/806, 349, 206/376, 377, 486, 493, 495, 459.5, 758, 759, 763

(56) References Cited

FOREIGN PATENT DOCUMENTS

| | | |
|---|---|---|
| 3407 122A1 | 8/1985 | (DE) . |
| 2 661 399 | 10/1991 | (FR) . |
| 363 792 | 2/1974 | (SE) . |
| WO 93/01102 | 1/1993 | (WO) . |

*Primary Examiner*—Paul T. Sewell
*Assistant Examiner*—Shian Luong
(74) *Attorney, Agent, or Firm*—Burns, Doane, Swecker & Mathis, L.L.P.

(57) ABSTRACT

Package for tools (10,20) or similar products which are displayed hanging from pegs, comprising a card (12,21) with a peg opening (13) and product information (14). The card is not easily removable from the product, and can by rotation or sliding be transferred from a first position with the opening and the information visible above the product to a second position behind the product.

7 Claims, 1 Drawing Sheet

TOOL PACKAGE

BACKGROUND

Tools such as screwdrivers, pliers, saw blades and measuring tools are often displayed at the point of sales by hanging individual packages onto pegs, where upper end of the individual package is a flat card with an opening to fit the peg. The card also carries information about the tool, including price, manufacturer and usage. During transport from the manufacturer to the point of sales, several individual packages are shipped together in a multiple package.

To facilitate recycling of packaging material from individual as well as multiple packages, they should be as small and simple as possible without impairing their ability to keep the tools from damaging or scratching each other. The present invention concerns a type of individual package, where the card with its information is openly visible to the customer when the tool is displayed by hanging from a peg at the point of sales, and relocated behind the tool as a protective intermediate layer when several individual packages are gathered in a multiple package. The card is also better protected from bending or creasing.

DESCRIPTION

Figure 1:
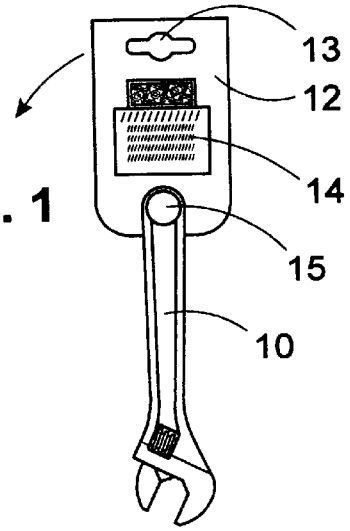
Figure 2:
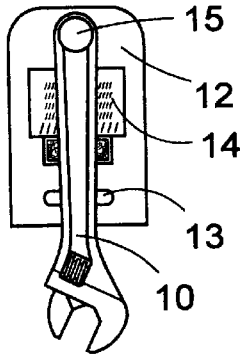
Figure 3:
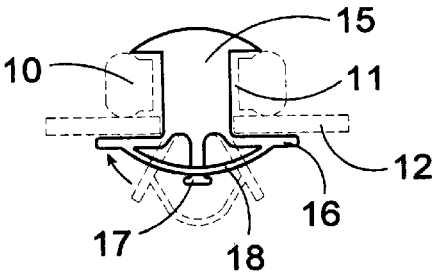
Figure 5:
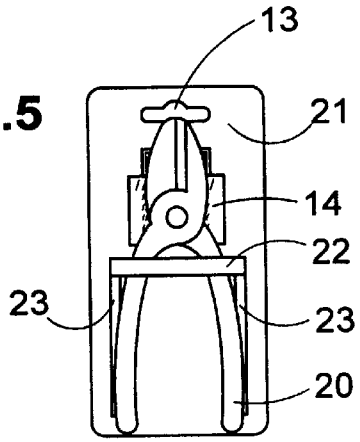
Figure 6:
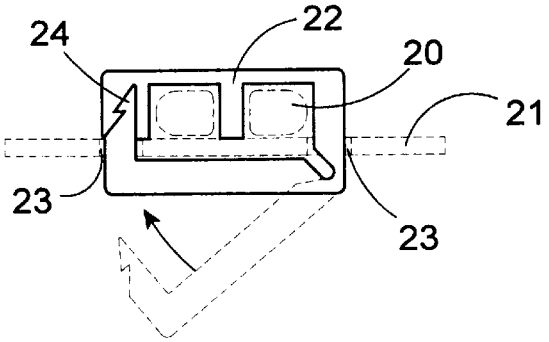

The invention is described with reference to the figures, where FIGS. 1 and 2 show an induvidual package for a wrench, FIG. 3 a rivet part of it, FIGS. 4 and 5 an individual package for a plier and FIG. 6 a clip part of it.

Tools (10) with an essentially flat shape and a hole (11) near one end should be attached to a card (12) as shown in FIG. 1 with the hole against one end of the card, which carries product information (14) in the middle and a peg opening (13) at the other end. The tool is attached to the card by a rivet (15) which cannot be removed without visible damage to the rivet or to the card. This ensures that the product information will accompany the tool until it has reached the user. When the tool is to be put in a multiple package, the card is rotated around the rivet (15) until it is behind the tool (10) as shown in FIG. 2. The height of the card should preferably not exceed the length of the tool. The rivet is fastened to the card in a way that it is not easily removable, such as by heat deformation, by barbs, or as shown in FIG. 3 by wings (16) which are unfolded after they have penetrated the card, and become locked in this position by support elements (18) which are caught by a locking element (17) when the wings are unfolded. The wings (16) can be folded back and the rivet be removed if the locking element (17) is cut off. If the hole (11) is round, the rivet may have an arbitrary cross-section. If the hole has another shape, the rivet can have a round section, or be rotatable relative to the card (12).

Tools without a hole (11) can be fastened to the card (12) if the rivet head is specially shaped to grip the tool, with or without auxiliary pieces.

Figure 4:
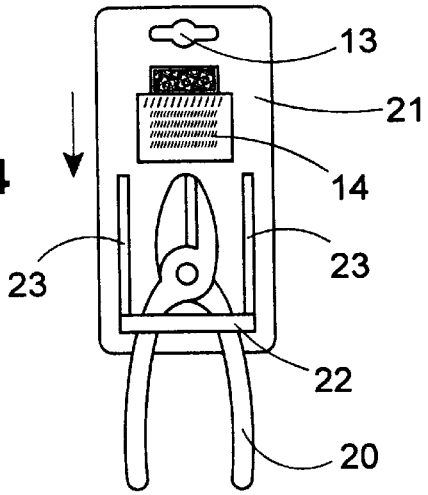

Tools which are not suitable to have one end fastened to the card, such as pliers (20), where the jaws at one end should be exposed to show their function and use, and the handles at the opposite end should simultaneously be exposed to let a buyer feel if they fit his hand, can be attached to a card in such a way that the card extends above the tool when it is displayed at the point of sale, as shown in FIG. 4. This is done with a clip (22) shaped to fit the tool (20) in such a way that the tool can not be removed from the card without damaging the clip or the card. One way to do this is to make the clip forming two passageways for the handles of the tool. The clip cooperates with the card in such a way that the card can be slid down behind the tool (20) as shown in FIG. 5. The clip (22) should be attached to the card in a slideable but not removeable way by penetrating one or more slots (23) or gripping the edges, and held by heat deformation or as shown in FIG. 6 by barbs (24). To remove the card from the tool (20) it is necessary to cut or break the clip or a locking element part of it.

To allow a smaller multiple package, the size of the card should be such that it will fit behind the tool, and has height and width not exceeding the height and width of the tool. For secure locating of the tools in the multiple package the width of the card should preferably be approximately equal to the greatest width of the tool.

The card can be made from various materials, such as cardboard or plastics. The rivet (15) or the clip (22) should preferably be made from plastics, such as polypropylene.

What is claimed is:

1. A package for products that are displayed by hanging, comprising:

a card for displaying the product;

said card including product information displayed thereon and a peg opening for hanging said card;

said card further including means for attaching the product to said card so that the product is movable about the attachment means from a first position wherein the product information is not covered by an opening tool to a second position wherein the product information is covered by the opening tool, wherein said attachment means includes a rivet, said rivet being attached through an opening in said card, wherein said rivet includes a plurality of wings which become unfolded after the wings have penetrated said opening in said card.

2. The package of claim 1, wherein said rivet includes a locking element which restricts movement of said wings whereby cutting the locking element allows said rivet to be removed from said card.

3. A package for products that are displayed by hanging, comprising: a card for displaying the product; said card including product information displayed thereon and a peg opening for hanging said card; said card further including means for attaching the product to said card so that the product is movable about the attachment means from a first position wherein the product information is not covered by an opening tool to a second position wherein the product information is covered by the opening tool, wherein said attaching means includes a clip for slidably attaching said card to the product, said clip being attached through first and second slots in said card, and wherein said clip is slidable along the slots between the first to second positions.

4. The package of claim 3, wherein said clip is removable after breaking at least a portion of said clip off.

5. The package of claim 3, wherein the clip forms two passageways for receiving handles of the product.

6. A package for products that are displayed by hanging, comprising:

a card for displaying the product;

said card including product information displayed thereon and a peg opening for hanging said card;

said card further including means for attaching the product to said card so that the product is movable about the attaching means from a first position wherein the product information is not covered by the tool to a second position wherein the product information is covered by the tool, wherein said attaching means includes a clip for slidably attaching said card to the product, said clip being attached through first and second slots in said card, and wherein said clip is slidable along the slots between the first to second positions.

7. The package according to claim 6, wherein said clip is removable after breaking at least a portion of said clip off.

* * * * *